United States Patent [19]

Hope et al.

[11] 4,150,589

[45] Apr. 24, 1979

[54] GEAR CONNECTING ARRANGEMENT

[76] Inventors: Henry F. Hope, 3192 Huntingdon Rd., Huntingdon Valley, Pa. 19006; Stephen F. Hope, 2548 Wyandotte Rd., Willow Grove, Pa. 19090

[21] Appl. No.: 848,388

[22] Filed: Nov. 4, 1977

Related U.S. Application Data

[63] Continuation-in-part of Ser. No. 819,126, Jul. 26, 1977, which is a continuation-in-part of Ser. No. 780,922, Mar. 24, 1977, which is a continuation-in-part of Ser. No. 737,199, Oct. 29, 1976, which is a continuation-in-part of Ser. No. 555,961, Mar. 10, 1975, Pat. No. 3,989,176, which is a continuation-in-part of Ser. No. 457,829, Apr. 4, 1974, abandoned, and Ser. No. 513,244, Oct. 9, 1974, Pat. No. 3,952,610.

[51] Int. Cl.[2] ..... F16H 1/12; B41F 5/16

[52] U.S. Cl. ..... 74/421 R; 74/439; 101/181

[58] Field of Search ..... 74/421 R, 412 R, 414, 74/434, 439, 325, 665, 665 GA; 101/181, 183, 216; 226/91

[56] References Cited

U.S. PATENT DOCUMENTS

| | | | |
|---|---|---|---|
| 1,677,472 | 7/1928 | Fuchs | 101/181 X |
| 3,841,216 | 10/1974 | Huffman | 101/181 |
| 3,952,610 | 4/1976 | Hope et al. | 74/421 R |
| 4,079,635 | 3/1978 | Hope et al. | 74/421 R |

*Primary Examiner*—Leonard H. Gerin

*Attorney, Agent, or Firm*—Weiser, Stapler & Spivak

[57] ABSTRACT

In a transport roller rack for automatic film developing machines, power gears supply the main flow of power to the rack, and cluster drive gears are coaxially rotated by the power gears to tap off fractions of the main power and supply these fractions to clusters of gears which in turn drive transport rollers.

Coaxial gear units are used at the power tap off point. Each unit has a plurality of axially displaced portions, one constituting the power gear, another the cluster drive gear. The unit is supported by a shaft for axial rotation, but the construction of the unit is such that the shaft need not be relied upon to transmit the coaxial rotation from power gear to cluster drive gear.

Such a coaxial gear unit greatly simplifies the construction and also leads to smoother operation with less risk of damage to the film.

21 Claims, 4 Drawing Figures

FIG. 1
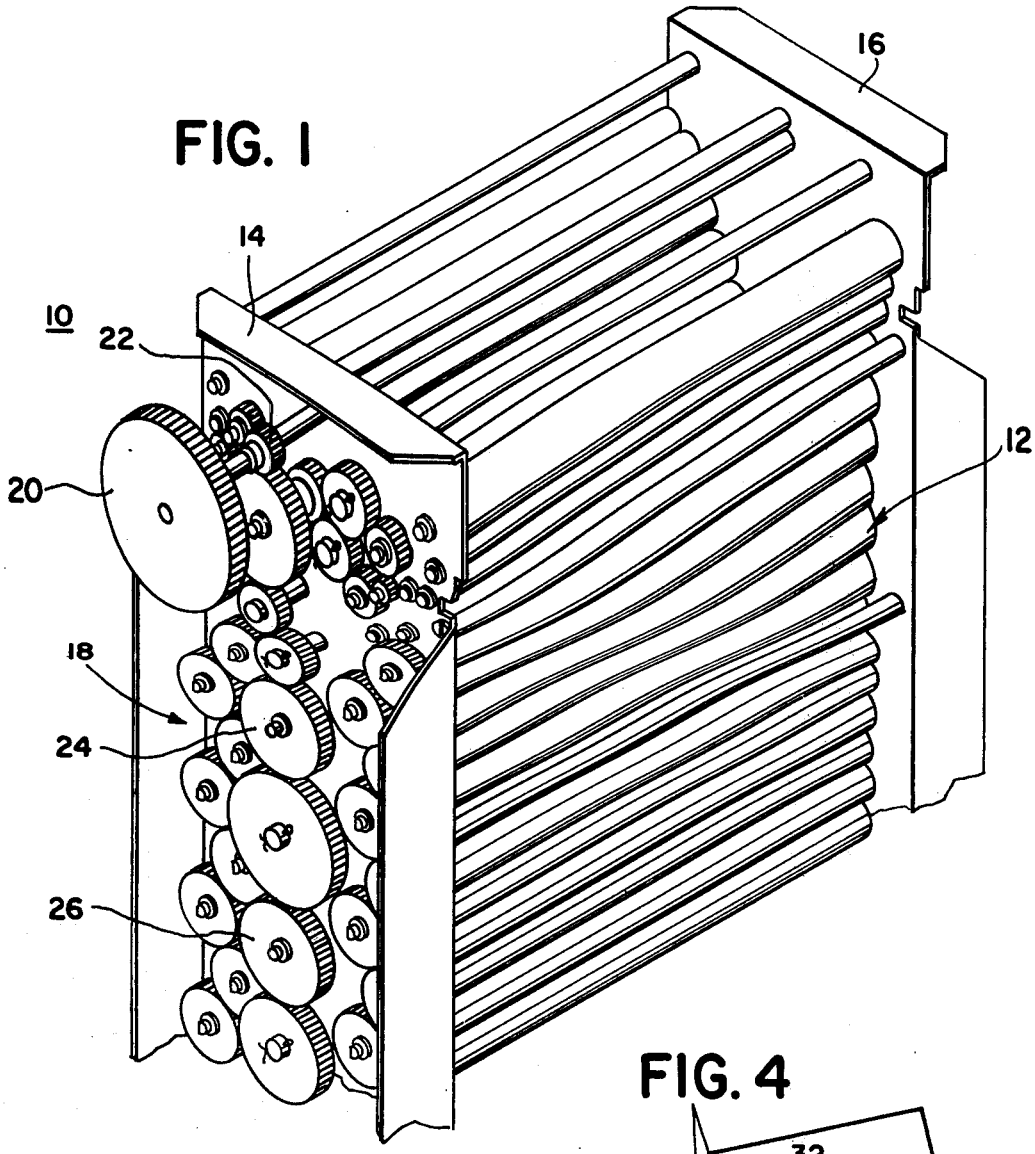
FIG. 4
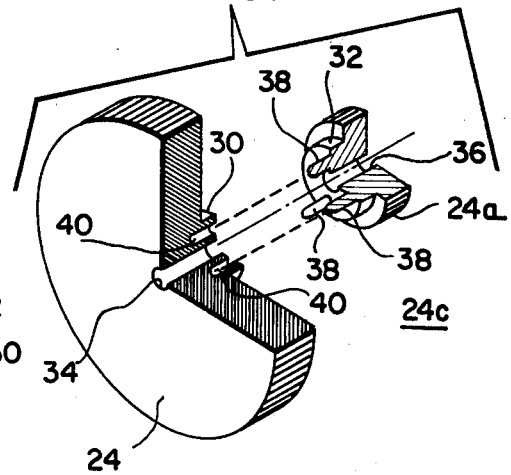
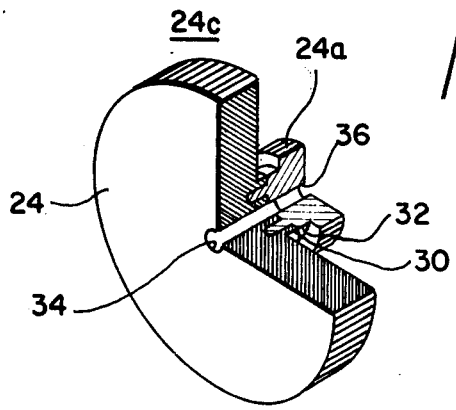
FIG. 3

GEAR CONNECTING ARRANGEMENT

RELATED CASES

This application is a continuation-in-part of our copending U.S. patent application Ser. No. 819,126, filed July 26, 1977, which in turn is a continuation-in-part of our patent application Ser. No. 780,922, filed Mar. 24, 1977, which in turn is a continuation-in-part of our patent application Ser. No. 737,199, filed Oct. 29, 1976, which in turn is a continuation-in-part of our patent application Ser. No. 555,961, filed Mar. 10, 1975, now U.S. Pat. No. 3,989,176, issued Nov. 2, 1976. The said application Ser. No. 555,961 in turn is a continuation-in-part of our patent applications Ser. No. 457,829, filed Apr. 4, 1974, now abandoned, and Ser. No. 513,244, filed Oct. 9, 1974, now U.S. Pat. No. 3,952,610, issued Apr. 27, 1976.

In the foregoing, prior patent applications and now issued patents, there is taught a highly efficient, novel concept for powering racks containing long strings of transport rollers. In accordance with that concept the main flow of power along the rack is provided by power transmitting gears which drive each other. Fractions of this main flow of power are tapped off, with accompanying torque multiplication, by means of gears of smaller pitch diameter coaxially rotated by respective power transmitting gears. Each of these smaller gears drives through meshing a cluster of gears which distribute the tapped-off power fraction to the transport rollers.

The present invention involves a still further improvement in one key portion of apparatus embodying this novel concept. In particular it involves further improvements in the arrangement for producing the coaxial rotation of the cluster drive gears by their respective power transmitting gears.

BACKGROUND OF THE INVENTION

This invention relates to an ingenious improvement in gear systems for power transmission, and is characterized by remarkable simplicity and utility.

In power transmission by means of gear systems there are instances in which the flow of power through the system takes place partly through meshing between adjoining gears and partly through rotation of gears coaxially by each other.

Examples of such gear systems are found in advanced types of machines for automatically developing photographic films, x-ray films and the like. Such machines typically include several compartments through which the films to be processed are successively transported. In these compartments there are performed the various processing operations, including developing, fixing, washing, drying, etc. Especially in advanced, highspeed models of such machines, long, rack-mounted strings of transport rollers are positioned in these compartments to accomplish the transporting of the films through the machine.

There are stringent requirements on the operation of these roller strings. They must be capable of being driven from one end, with a minimum of input power, and they must rotate very smoothly, uniformly, and free from abrupt or jerking movements which could damage the films being processed.

Gear systems capable of being used for such roller racks in a manner which satisfies all of these stringent requirements are taught in our prior patents and patent applications including particularly those listed above.

These gear systems are characterized by the fact that the power flow through the system takes place in two distinctly different ways. Part of this power flow takes place through meshing of consecutive gears. Other parts take place through coaxial connection of one gear with another.

In particular, the transport racks characterizing our prior inventions generally utilize a train of power gears, along which the main flow of power for the rack is transmitted through meshing of consecutive gears in the train (including intermediate reversing gears if appropriate). From different ones of this train of power gears there are then tapped-off fractions of this main flow of power. These tapped-off power fractions are utilized to drive clusters of gears which in turn rotate the individual transport rollers.

The tapping-off of the desired fractions of the main power flow is accomplished by utlizing, at each tap-off point, a cluster drive gear which is smaller in pitch diameter than the corresponding power gear, and which is rotated by that power gear not through meshing, but rather through a coaxial connection.

As is fully set forth in our prior patents and patent applications, film processing machines featuring such a system are remarkably superior to other types.

SUMMARY OF THE INVENTION

We have now found that a further appreciable improvement in such systems can be made at the points at which there takes place the tapping-off of portions of the main flow of power.

As previously stated, this tapping-off takes place by means of a cluster drive gear which is rotated by a power gear coaxially rather than through meshing.

In accordance with the present invention, the power gear and the cluster drive gear which it coaxially rotates are constituted by axially displaced portions of a single coaxial gear unit. This unit has an axial aperture for receiving a shaft which supports the unit for rotation about the axis. However, it is not this shaft which is relied upon to transmit rotation coaxially from the power gear portion to the cluster drive gear portion. Rather, this coaxial rotation results from the fact that the two portions are constructed so as to form a single unit.

Preferably, the portions of the gear unit which constitute the power and cluster drive gears, respectively, are capable of being taken apart. To that end, one portion preferably has pins protruding parallel to the axis, and the other portion has mating recesses for receiving these pins.

Coaxial gear units in accordance with our present invention possess conspicuous advantages over the more obvious arrangements. In the latter, the common shaft which supports the gears also serves to transmit the coaxial rotation from one gear to the other. To that end, the gears must be mounted in some manner so that they and the shaft all rotate in unison. This can be accomplished in various ways, all of them somewhat complicated and consequently adding to expense both in manufacture and assembly. For example, the shaft may be provided with a keyway of appropriate configuration, while the interiors of the gear hubs are matingly shaped. This requires costly machining of the shaft. It also requires careful angular orientation of the gears with respect to the shaft during assembly. Since each machine typically requires a multiplicity of such coaxial gear arrangements, this matter of assembly difficulty can assume serious proportions. These difficulties increase still further if it becomes necessary to replace such a gear arrangement in the field, where these gears are typically positioned in comparatively inaccessible locations inside the compartments of the machine.

Another basic requirement of a coaxial gear arrangement which relies on a shaft to transmit the rotation from one gear to the other is that the shaft itself must also be rotatable. This means that the shaft has to be mounted in bearings, which are not only costly but also subject to wear. Also, depending on the strains involved, it may be necessary to journal each shaft in bearings at more than one point, which further intensifies this disadvantage.

Finally, such arrangements which rely on mounting of the gears for rotation in unison with their common supporting shaft, have the possibility that angular play may develop between shaft and gears. This can then lead to loss of smoothness of transport system operation, and consequent serious harm to the quality of film development.

All of these problems are solved, at one stroke, by the present invention.

The supporting shaft for the coaxially gear unit embodying the invention can be simply of round stock, with no need for any special keyway-like configuration. As a further result, the gear unit can be slipped onto and off this shaft without requiring specific angular orientation relative to the shaft.

The shaft itself does not need to be rotatable, but can be fixedly pinned to the rack without requiring bearings of any kind for the shaft.

There can be no harmful effects upon film development due to angular play between shaft and gears.

Accordingly, it is a principal object of this invention to provide an improved arrangement for coaxially rotating one gear with another.

It is another object to provide a gear system in which power is tapped off from a train of power gears to a cluster of gears by means of cluster drive gears which are coaxially rotated by the power gears through an improved arrangement.

It is still another object to provide such an improved arrangement which is characterized by structural simplicity of components.

It is still another object to provide such an improved arrangement which is characterized by ease of assembly and disassembly.

It is still another object to provide such an arrangement which is characteristized by freedom from wear and tear.

It is still another object to provide a film processing machine utilizing such an arrangement and characterized by increased smoothness of operation.

A fuller understanding of the invention will be had by referring to the following description of the preferred embodiments thereof, taken in conjunction with the accompanying drawings, wherein like reference characters refer to similar parts throughout the several views in which:

BRIEF DESCRIPTION OF THE DRAWINGS

FIG. 1 shows an overall view of a portion of a film processing machine transport roller rack utilizing gear arrangements embodying the invention;

FIG. 3 shows one of the inventive gear arrangements utilized in FIGS. 1 and 2, partially broken away, and to a somewhat larger scale than in FIGS. 1 and 2; and FIG. 4 shows the gear arrangement of FIG. 3 exploded into its two constituent portions.

DESCRIPTION OF THE PREFERRED EMBODIMENTS OF THE INVENTION

Figure 2:
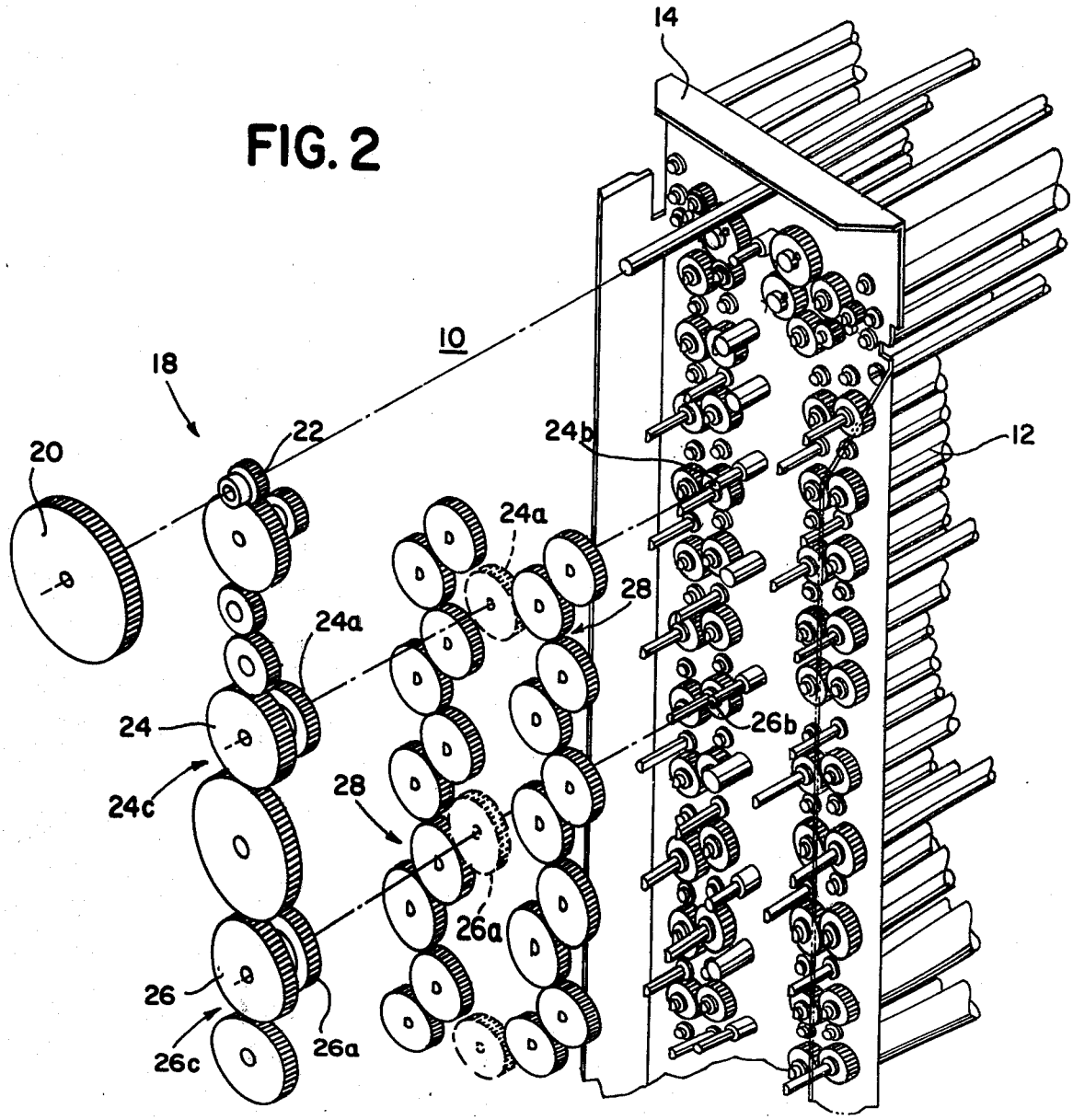
FIG. 2 is an exploded view showing the several tiers of gears which characterize the transport rack of FIG. 1.

As previously stated, the gear arrangement embodying the present invention finds one of its applications in the transport roller racks of modern automatic film developing machines. An overall view of the upper portion of such a rack is shown at 10 in FIG. 1. This particular rack 10 is similar to that illustrated and described in our above-mentioned copending patent application Ser. No. 819,926, now U.S. Pat. No. 4,096,574. Only the upper position of this rack is shown in the present application because this is believed to be sufficient to illustrate the present invention.

Referring to FIGS. 1 and 2, the rack 10 has a string of rollers 12 which guide and transport the films to be developed down one side of the rack and back up the other side. These rollers are mounted between side frames 14 and 16, which also support a system of gears 18 for driving the rollers 12.

It will be understood that rack 10 also has a lower portion, which is not shown in FIG. 1 for the sake of simplicity of illustration. This lower portion continues the rack 10 downwardly, and also has provisions for turning the films about at the bottom of the rack so that, after being first transported downwardly along one side, they are then again transported upwardly along the other side of the rack 10.

For further details of the overall construction and operation of the entire rack 10, reference is made to our abovementioned prior, copending application Ser. No. 819,926, whose contents are hereby incorporated in the present application as though fully set forth herein.

In this rack 10, the power for rotating all the components of the rack is introduced at the top through power input gear 20, which coaxially rotates gear 22. From gear 22, the main flow of power down the rack takes place through a train of consecutively meshing gears, including particularly power gears 24 and 26.

Not visible in FIG. 1, but shown in the exploded view of FIG. 2, to which reference may now be had, are gears **24*a* and 26*a* mounted so as to be coaxially rotated by power gears 24 and 26, respectively. These coaxially rotated gears 24*a* and 26*a* serve to tap off fractions of the power flowing down the train of gears which includes power gears 24 and 26**.

In turn, these gears **24*a* and 26*a* rotate, through meshing, clusters of gears 28**.

In accordance with the present invention, each power gear (24 and 26) and the cluster drive gear (**24*a* and 26*a***) which it coaxially rotates form a coaxial gear unit.

FIG. 3 shows in greater detail the construction of one such a coaxial gear unit **24*c*. This unit 24*c* has two separable portions, one of which constitutes the power gear 24 and the other the cluster drive gear 24*a*. As shown in FIG. 3, these separable portions have hubs 30, 32 and are traversed by cylindrical axial apertures 34, 36. Protruding from hub 32 are pins 38 which fit matingly into corresponding recesses 40 in hub 30**.

The same unit 24c, but with its two portions separated, is illustrated in FIG. 4. This figure shows the pins 38 spaced uniformly around the circumference of hub 32. The recesses 40 are, of course, correspondingly uniformly spaced about hub 30.

A similar gear unit 26c is formed of two separable portions constituting the power gear 26 and cluster drive gear 26a shown in FIG. 2.

Shafts 24b and 26b respectively support gear units 24c and 26c (FIG. 2). These are simple cylindrical shafts, without any keyway-like configurations. The respective gear units may be free to rotate about these shafts, and the shafts themselves need no bearings, but may be fixedly pinned to their adjoining side frame 14.

The gear units 24c, 26c may be made of any desired materials. Preferably, however, they are molded of plastic, each constituent portion being made in a single operation, complete with its protruding pins, or corresponding recesses, as appropriate.

The advantages of the present invention will now be apparent.

All the components of the gear unit are extremely uncomplicated, and correspondingly economical.

The assembly of a gear unit is very simple and convenient, and so is the mounting on its supporting shaft, and the demounting and disassembly, if needed.

There is virtually no possibility of angular play between the gears, and therefore no danger to film development quality from this cause.

It will be understood that many variations in the gear unit are possible without departing from the inventive concept.

The means for uniting the separable portions of the gear unit need not necessarily be in the form of the pins and recesses shown herein. These are preferred, because they make assembly and replacement exceptionally convenient. However, these portions can also be united by screws, or even by adhesive or by fusion of the respective plastic bodies.

The application of such gear arrangements is also not limited to transport roller racks for film developing machines. In such racks, they are particularly advantageous because they provide an extremely simple and yet effective means for accomplishing the power tap-off with torque multiplication which characterizes such racks embodying our inventions. However, other applications for such coaxial gear units will occur to those skilled in the art, in power transmission systems.

We claim:

1. In a transport roller rack for automatic film processing machines, which rack includes power gears simultaneously driven and supplying the main flow of power to the rack, clusters of meshing gears for supplying fractions of the main power flow to the rollers, and means for tapping off the said fractions of the power from the power gears, the tapping-off means comprising cluster drive gears coaxially rotated by power gears and driving through meshing clusters of gears, the improvement wherein:

at least one power gear and the cluster drive gear which it coaxially rotates are constituted by different portions of a single coaxial gear unit.

2. The rack of claim 1 wherein the gear unit is supported for rotation by a shaft, but without relying on that shaft to transmit the rotation from one portion of the gear unit to the other.

3. The rack of claim 1 wherein the portion of the gear unit constituting the cluster drive gear is axially displaced from the portion constituting the power gear.

4. The rack of claim 3 wherein the portions of the gear unit constituting the power and cluster drive gears have gear surfaces which are in coaxial alignment with each other.

5. The rack of claim 4 wherein the portions of the gear unit are united at their hubs.

6. The rack of claim 1 wherein the gear unit portions are adapted to be taken apart.

7. The rack of claim 6 wherein the gear unit includes means for uniting the different portions of the unit without relying on a common supporting shaft.

8. The rack of claim 7 wherein the uniting means includes pins projecting parallel to the axis from one portion of the unit, and mating recesses in the other portion of the unit.

9. The rack of claim 1 wherein the gear unit has an axial aperture traversed by a supporting shaft, the shaft and aperture being both free of keyway-like configurations.

10. The rack of claim 9 wherein the supporting shaft is non-rotatably attached to the rack.

11. The rack of claim 1 wherein the gear unit includes a hollow hub of outer diameter smaller than the pitch diameters of the gears and spacing the gears axially from each other.

12. The rack of claim 1 wherein there is a plurality of the coaxial gear units.

13. A coaxial gear unit comprising:

a plurality of axially displaced portions, each portion constituting a different gear in the unit, and an axial aperture within the unit capable of receiving a shaft to support the unit for rotation about its axis, the different portions of the unit being united with each other independently of the shaft, whereby rotation imparted to one gear in the unit produces coaxial rotation of another gear in the unit without relying upon the shaft to transmit the rotation.

14. The gear unit of claim 13 wherein the axially displaced portions are adapted to be taken apart.

15. The gear unit of claim 13 wherein the axially displaced portions are adapted to be taken apart and reassembled.

16. The gear unit of claim 14 wherein one portion has pins protruding substantially parallel to the axis, and the other portion has matingly shaped recesses for receiving the pins.

17. The gear unit of claim 14 wherein each portion has a hub integral with and protruding axially from the portion, the hub having an axial aperture for receiving the supporting shaft, and means for fastening the different portions at the hubs.

18. The gear unit of claim 17 wherein the fastening means includes pins protruding from one hub, and matingly shaped recesses for receiving the pins in another hub.

19. A gear system utilizing the gear unit of claim 13 and comprising:

at least one additional gear meshing with one of the gears of the unit.

20. The gear system of claim 19 further comprising:

at least one additional gear meshing with another gear of the unit.

21. The gear system of claim 20 wherein the gears in the unit are of different pitch diameters.

* * * * *